United States Patent [19]

Nguyen

[11] 4,297,404

[45] Oct. 27, 1981

[54] NON-WOVEN FABRIC COMPRISING BUDS AND BUNDLES CONNECTED BY HIGHLY ENTANGLED FIBROUS AREAS AND METHODS OF MANUFACTURING THE SAME

[75] Inventor: Hien V. Nguyen, East Windsor, N.J.

[73] Assignee: Johnson & Johnson, New Brunswick, N.J.

[21] Appl. No.: 110,719

[22] Filed: Jan. 9, 1980

Related U.S. Application Data

[63] Continuation-in-part of Ser. No. 31,086, Apr. 18, 1979, abandoned, which is a continuation-in-part of Ser. No. 806,033, Jun. 13, 1977, abandoned.

[51] Int. Cl.[3] ..... D04H 1/46; D04H 1/70

[52] U.S. Cl. ..... 428/85; 28/105; 428/131; 428/156; 428/218; 428/224; 428/913

[58] Field of Search ..... 428/131, 280, 85, 156, 428/218, 913, 224; 19/161 P; 28/78, 104, 105

[56] References Cited

U.S. PATENT DOCUMENTS

| | | | |
|---|---|---|---|
| 2,862,251 | 12/1958 | Kalawaites | 19/161 P |
| 3,033,721 | 5/1962 | Kalwaites | 428/224 |
| 3,081,515 | 3/1963 | Greswold et al. | 428/131 |
| 3,485,706 | 12/1969 | Evans | 19/161 P |
| 3,679,535 | 7/1972 | Kalwaites | 428/131 |
| 3,679,536 | 7/1972 | Kalwaites | 428/131 |
| 3,681,182 | 8/1972 | Kalwaites | 428/131 |
| 3,681,183 | 8/1972 | Kalwaites | 28/105 |
| 3,681,184 | 8/1972 | Kalwaites | 428/134 |
| 3,682,756 | 8/1972 | Kalawaites | 19/161 P |
| 3,750,236 | 8/1973 | Kalwaites | 28/104 |
| 3,750,237 | 8/1973 | Kalwaites | 28/105 |
| 3,768,121 | 10/1973 | Kalawaites | 19/161 P |
| 3,769,659 | 11/1973 | Kalwaites | 28/104 |
| 3,787,932 | 1/1974 | Kalwaites | 28/105 |
| 3,800,364 | 4/1974 | Kalwaites | 28/105 |
| 3,837,046 | 8/1974 | Kalwaites | 28/105 |

*Primary Examiner*—James J. Bell
*Attorney, Agent, or Firm*—Robert L. Minier

[57] ABSTRACT

A non-woven fabric having a plurality of patterns of groups of fiber segments that alternate and extend throughout the fabric. One pattern is disposed in discontinuous portions of the fabric, each of which portion include at least one pivotal packing of fiber segments protruding out of the general plane of the fabric and a yarn-like bundle of fiber segments attached to said pivotal packing by ribbon-like groups of aligned fiber segments extending from the pivotal packing. The discontinuous portions of the fabric are interconnected by highly entangled fibrous areas which form a continuous pattern throughout the fabric.

11 Claims, 6 Drawing Figures

NON-WOVEN FABRIC COMPRISING BUDS AND BUNDLES CONNECTED BY HIGHLY ENTANGLED FIBROUS AREAS AND METHODS OF MANUFACTURING THE SAME

The present application is a continuation-in-part application of my co-pending patent application Ser. No. 31,086 filed Apr. 18, 1979 now abandoned, which in turn was a continuation-in-part application of my patent application Ser. No. 806,033 filed June 13, 1977 now abandoned.

BACKGROUND OF THE INVENTION

The present invention relates to a non-woven fabric and more particularly to pattern non-woven fabrics made from a layer of fibrous material such as a fibrous web, wherein the individual fiber elements are capable of movement under the influence of applied fluid forces. The patterns in the fabric are patterns of groups of fiber segments. One pattern comprises pivotal packings of fiber segments or nubs protruding out of the plane of the fabric along with a yarn-like fiber bundle with the nub connected to the bundle by groups of aligned fibers extending from the nub.

A second pattern comprises highly entangled areas of fibers, where the fibers interentangle in the longitudinal and transverse directions and through the thickness of the fabric. The second pattern is continuous and extends throughout the fabric and connects the discontinuous pattern described above.

For a number of years there have been known various types of foraminous apertured non-woven fabrics made by processes involving the re-arrangement of fibers in the starting web or layer of fibers. Some of these fabrics and methods of manufacture are illustrated, shown and described in U.S. Pat. Nos. 2,862,251; 3,081,500; and 3,081,515. The fabrics disclosed and claimed in the patents just listed contained apertures or holes or other areas of low fiber density outlined by interconnected bundles of fibrous elements, wherein the fiber segments within the bundle are closely associated and parallel and have a yarn like configuration.

Another type of apertured non-woven fabric is shown, illustrated, and described in U.S. Pat. No. 3,033,721. The fabric disclosed in that patent comprises protuberant pivotal packings of fibers, which protrude out of the plane of the fabric and are interconnected by flat ribbon like groups of aligned fiber portions which define low fiber density areas therebetween. Such fabrics are generally termed "rose-bud", non-woven fabrics.

Another type of apertured non-woven fabric is shown, illustrated and described in U.S. Pat. No. 3,485,706. The fabric disclosed in that patent comprises highly entangled fiber areas. The fibers have been so highly entangled in "rose-bud" type configurations or similar configurations that the fabric is strong without requiring the addition of binder.

Still further types of fabrics are disclosed in U.S. Pat. Nos. 3,682,756 and 3,681,183 which disclose various combinations of yarn-like bundle patterns and protuberant pivotal packings or "rose-bud" type patterns in various combinations to produce uniquely patterned non-woven fabrics. Most all of these rearranged non-woven fabrics are made by supporting a fibrous web or layer of fibers on a permeable backing member and applying sets of opposing fluid forces to the layer while thus supported. The fluid by which the forces are applied passes through the layer over the backing member and through the backing member to pack various groups of fibrous elements and place these elements into closer proximity and substantial parallelism to form bundles of fiber segments. To produce "rose-bud" fabrics, the layer is supported on a perforated backing member and again fluid is applied over the layer while supported. A vacuum or suction means is placed behind the perforated member to draw the fluid through the layer and out through the perforations.

SUMMARY OF THE INVENTION

I have discovered a novel non-woven fabric which comprises a layer of intermingled fibers with the fibers arranged to define a plurality of patterns. The first pattern is one of discontinuous areas. Each of these areas has at least one pivotal packing of fiber segments, which protrude out of the plane of the fabric. The pivotal packing comprises fiber segments which are interentangled and in helter-skelter arrangement. The discontinuous areas also include a yarn-like bundle. The yarn-like bundle comprises fiber segments, wherein the segments are closely associated and generally parallel to the longitudinal axis of the bundle. The bundle and pivotal packed area are connected to each other by flat ribbon-like groups of aligned fibers which extend outwardly from the pivotal packing to the fiber bundle. The discontinuous pattern is interconnected throughout the fabric by a continuous pattern of highly entangled fiber portions. The fibers in this continuous pattern are highly entangled in the longitudinal direction of the fabric, the transverse direction of the fabric and throughout the thickness of the fabric to produce a strong fabric with considerable esthetic appeal.

My new fabric has a substantial uniformity of pattern of areas and has excellent strength characteristics and may even be used without any additional binder. If additional binder is required, it only need be used in minor amounts to produce products that are very soft and have good absorptive capacity. Also, the new non-woven fabric of the present invention unexpectedly has a depth or three dimensional appearance which makes it look as though it were a multi-layered fabric. In a preferred embodiment, my new fabric has what appears to be cones extending through the thickness of the fabric with the wide diameter of the cone formed by very dense areas on one surface of the fabric and which extend to a pivotal protuberance on the other surface of the fabric. This unexpected three dimensional or multi-planar configuration provides the fabric with a "cling" and with excellent softness characteristics.

Surprisingly, my new fabric has a relatively low bulk density while maintaining good tenacity. This is unexpected since generally as tenacity is increased by increasing the energy used to produce the fabric, the thinner and less bulkier the fabric becomes. However, my new fabric, while having a tenacity of at least 0.5 pounds per inch per 100 grains per square yard, will have a bulk density in the range of from 0.04 to 0.084 grams per cubic centimeter. Furthermore, my new fabric has good absorbency characteristics in that it will have a capacity for absorbing liquid of at least 7½ times its own weight.

METHOD OF MAKING THE FABRIC OF THIS INVENTION

In manufacturing my new non-woven fabric, a starting layer of fibrous material, the individual fibrous elements of which are capable of movement under the influence of applied fluid forces is subjected to fluid rearranging forces, preferably liquid, while the layer is supported on a permeable backing member. The backing member has a predetermined topography. The fluid flows over the surface and through the backing member. The fluid is directed against the fibrous layer while it is on the backing member through a member which is apertured. The fibrous layer is placed on the backing member and the apertured member placed on top of the fibrous layer and fluids directed through the apertured member to act on the fibrous layer and then out through the permeable backing member. The apertured member is removed and the backing member with the fibrous material thereon is placed beneath an apertured member for a second time. It may in fact be the same apertured member as the first time but the second time there is a different registry between the areas of the fibrous layer and backing member and apertures. The fibrous layer is again treated with fluid passing through the apertured member through the fibrous layer and out through the permeable backing member. The fluid flow causes counteracting components of force to act beneath the land areas in apertured members to rearrange fibers into yarn-like bundles. The fluid flow also causes other components of force to act on the fibrous layer to pack fiber portions into groups of pivotal packings in accordance with the pattern of permeable areas in the backing member. The fluid flow causes yet other components of force to act on the fibrous layer to form a continuous interconnecting pattern of highly entangled interlaced fibers in the longitudinal and transverse direction of the fabric as well as through the thickness of the fabric.

Surprisingly, the above described plural treatment of the fibrous layer wick the drum and belt out of registry in each subsequent treatment and does not densify the fibrous layer over the original treatment. What this plural treatment does accomplish is to increase the tenacity of the fibrous layer without increasing the bulk density of the fabric produced to unexpectedly produce a bulkier and highly absorbent product. The basic method and apparatus for making the fabric of this invention are shown and described in U.S. Pat. No. 2,862,251 issued Dec. 2, 1958. Full particulars of the basic invention as disclosed in that patent are incorporated in this application by reference although some of those particulars are repeated here. In addition, the specific features peculiar to the method and apparatus for making the fabrics of the present invention are described in detail below.

The starting material used with the method and apparatus for making the fabrics of this invention can be any of the standard fibrous webs such as oriented card webs, isowebs, air-laid webs or webs formed by liquid deposition. The webs may be formed in a single layer or by laminating a plurality of the webs together. The fibers in the web may be arranged in a random matter or may be more or less oriented as in the card web. The individual fibers may be relatively straight or slightly bent. The fibers intersect at various angles to one another such that adjacent fibers come into contact only at the points where they cross. The fibers are capable of movement under forces applied by fluids such as water, air, etc.

To produce the fabric having the characteristic hand and drape of a textile fabric, the starting material used with the method and apparatus of this invention may comprise natural fibers such as cotton, flax, etc.; mineral fibers such as glass, artificial fibers such as viscose rayon, cellulose acetate, etc.; or synthetic fibers such as the polyamides, the polyesters, the acrylics, the polyolefins, etc., alone or in combination with one another. The fibers used are those commonly considered textile fibers, that is, generally having a length from about $\frac{1}{4}''$ to about 2 to $2\frac{1}{2}''$. Satisfactory products may be produced in accordance with this invention from starting webs weighing between 80 grains per square yard to 2,000 grains per square yard or higher.

The apertured forming means used with the method and apparatus for making the fabrics of this invention has apertures disposed longitudinally and transversely across its area with land areas lying between the apertures. The forming apertures may have any desired shape; that is, round, square, diamond, oblong, free form, etc. and may be arranged in any desired pattern over the surface of the forming means.

The land areas of the aperture forming means that lie between and interconnect the forming apertures may be narrow or broad in comparison to the forming apertures as desired.

As two aperture forming means are used in the method and apparatus of the present invention, the aperture forming means may either be the same or different in size, shape, pattern, or any combination thereof of the apertures.

The backing means is a foraminous member and is usually a woven wire mesh with hills and valleys where the wires cross each other. The wires or filaments are woven fairly loose to produce openings or foramen in the backing member and depending on the properties of the filaments or wires used, the configuration where one wire crosses another wire may vary both in depth and slope.

The rearranging fluid for use with this invention is preferably water or similar liquid or it may be other fluids such as gas as described in U.S. Pat. No. 2,862,251.

BRIEF DESCRIPTION OF DRAWINGS

The invention will be more fully described in conjunction with the accompanying drawings, wherein.

DETAILED DESCRIPTION OF SPECIFIC EMBODIMENTS OF THE INVENTION

Figure 1:
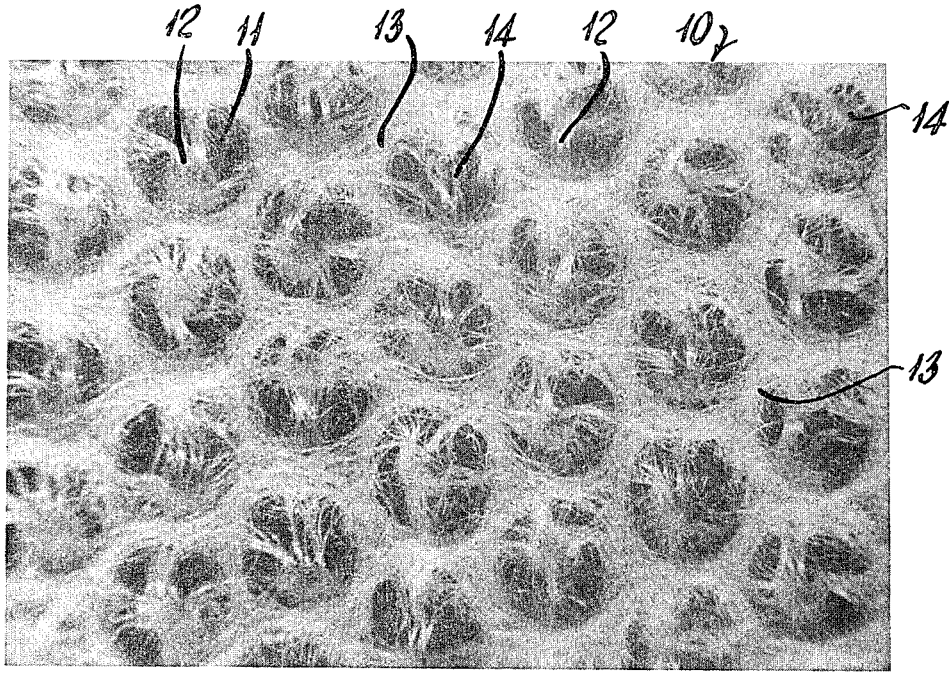
FIG. 1 is a photomicrograph of a fabric of the present invention at an original enlargement of 16 times.

Referring to photomicrograph in FIG. 1, there is shown a non-woven fabric 10 of the present invention. The fabric comprises a regular or predetermined pattern of areas in discontinuous portions of the fabric. Each area 11 is circular and has at least one pivotal packing of fiber segments 12. The pivotal packings protrude out of the plane of the fabric. The fiber segments in the pivotal packings are interentangled and in helter-skelter arrangement. The pivotal packings are attached to a yarn like bundle 13. The yarn-like bundle comprises fiber segments in substantial parallelism and in close proximity. The packings and bundles are connected by groups of aligned fibers 14 which extend from the pivotal packings to the yarn-like bundles. In FIG. 1, the circular areas are bound and interconnected throughout the fabric by highly entangled fibrous areas 15. The highly entangled and interlaced fibrous areas extend in all directions of the fabric including the thickness of the fabric.

Figure 2:
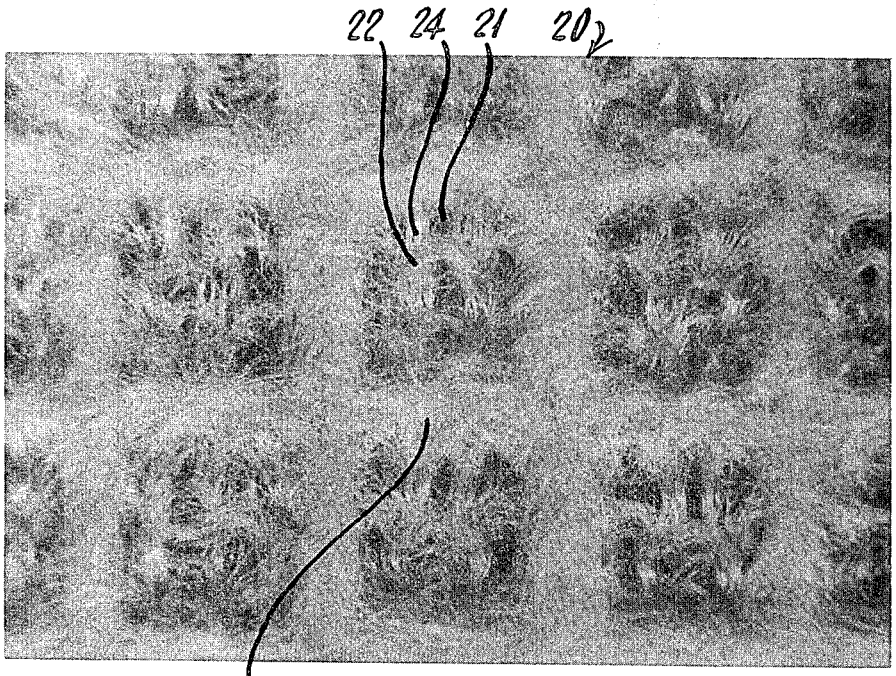
FIG. 2 is a photomicrograph of another fabric of the present invention at an original enlargement of 4 times.

Referring to the photomicrograph in FIG. 2, there is shown another non-woven fabric 20 of the present invention. In this embodiment, the areas 21 containing the pivotal packings 22 of fibers are substantially square in configuration. The square areas contain pivotal packing 22 of entangled, helter-skelter fiber arrangement and yarn-like fiber bundles 23 with fiber segments in close proximity and substantial parallelism. The pivotal packings 22 and the fiber bundles 23 are connected to one another by groups of ribbon-like fiber segments 24.

The square areas are bound and interconnected throughout the fabric by highly entangled, interlaced fiber segments 25 with the fibers being interlaced in all directions including the thickness of the fabric.

In both FIGS. 1 and 2, it can be seen that portions of fibers extend into the discontinuous areas and in many instances through the discontinuous areas.

The fabrics produced in accordance with the present invention have a bulk density range of between 0.04 and 0.084 grams per cubic centimeter. On the average, the fabrics of the present invention have a bulk density of 0.052 to 0.078 grams per cubic centimeter. The bulk density of the fabric is determined by measuring the fabric thickness as set forth in the ASTM Standard Method for Measuring Thickness of Textile Materials D1777-64. The weight in grams of a specific size sample of the fabric is also measured and the bulk density calculated by dividing the weight per unit area by the thickness.

The fabrics of the present invention have good tenacity; that is, tenacities of at least 0.5 pounds per inch of width per 100 grains per square yard. Generally, the tenacities of fabrics produced in accordance with the present invention will be in the range of from 0.5 to 0.75 pounds per inch of width per 100 grains per square yard. The tenacity is determined by measuring the breaking load of the fabric in both the machine and cross directions using the one inch strip test method set forth in ASTM Standard Test Method for Breaking Load and Elongation of Textile Fabrics D 1682.64.

The tenacity of the fabric is then calculated by finding the square root of the product of the machine direction breaking load times the cross direction breaking load.

Since the new and improved fabrics of the present invention have low bulk densities, they have good absorbent capacities. Fabrics of the present invention hold as least 7½ times their weight of water and in some instances as much as 10½ times their weight of water. On the average, the fabrics of the present invention hold about 9 times their weight of water. The absorbency of the fabric is determined by taking four, 4 inch by 4 inch samples, of the fabric and determining the weight of samples in grams at ambient conditions. The 4 layer sample is placed in a tray and a 400 gram 4 inch by 4 inch metal plate with a ¾ inch diameter center hole placed on top of the sample. Water from a burnette is poured through the center hole as fast as possible without overflow. Water is added until the sample is saturated and the sample allowed to absorb for 15 seconds. The tray is tilted 30 degrees and all excess water that drains in one minute is collected in a graduated cylinder. The absorbent capacity of the sample is then calculated by subtracting the milliliters of water collected in the graduated cylinder from the milliliters of water added from the burnette and dividing that result by the dry weight of the sample in grams.

DESCRIPTION OF MACHINE AND METHOD FOR MAKING FABRICS OF MY INVENTION

Figure 3:
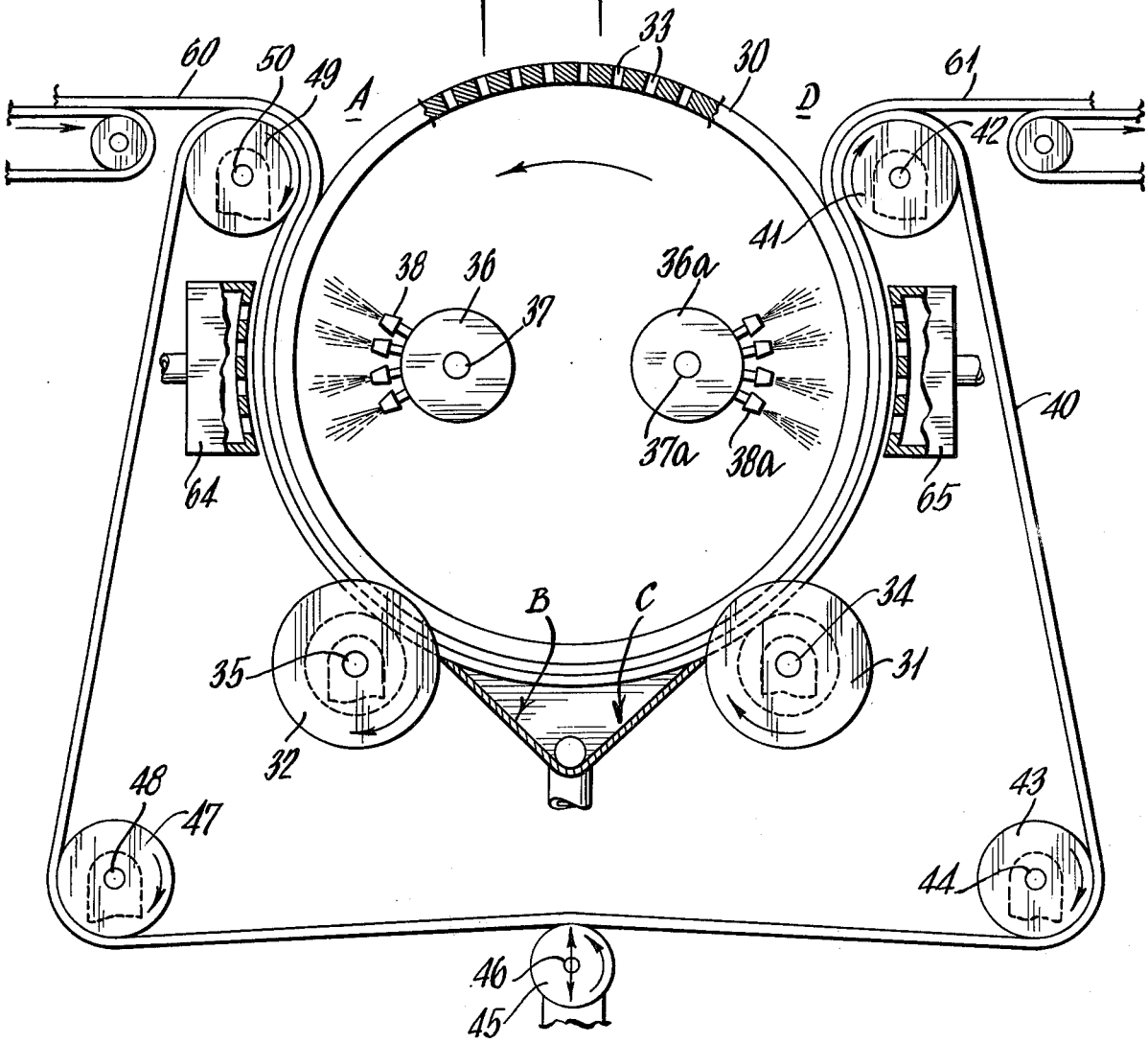
FIG. 3 is a diagramatic showing an elevation of one type of apparatus for carrying out the method for producing fabrics of the present invention.

Referring to FIG. 3 in the drawings, there is shown one form of apparatus for carrying out methods to produce products in accordance with the present invention. Full particulars of this apparatus, except for the details of the novel aspects of the present invention, including methods of mounting, rotating, etc., are fully described in U.S. Pat. No. 2,862,251 issued Dec. 2, 1958, and are incorporated in the present application by reference and thus need not be described in complete detail herein. In view of this reference, the apparatus of FIG. 3 will be described in general terms insofar as essential elements are the same in the patent just mentioned, and the novel elements of this apparatus; that is, the removal and replacement of the backing or supporting member will be described in more detail.

The apparatus includes a rotatable perforated drum 30 suitably mounted on flange guide wheels 31 and 32. The drum has apertures 33 uniformly spaced over its entire surface. The guide wheels are mounted for rotation on shafts 34 and 35. Inside the drum there is stationarily mounted along the full width of the drum, a manifold 36 to which a fluid is supplied through conduit 37. On one side of the manifold is a series of nozzles 38 for directing the fluid against the inside surface of the drum. In the embodiment shown, there is a second manifold **36*a* for directing the fluid against the inside of the drum at another portion along the inside perimeter of the drum. A backing or supporting member 40 is arranged to travel with the drum 30** as will be described hereinafter. (The terms "backing member" and "support member" are used interchangeably throughout this description).

Figure 4:
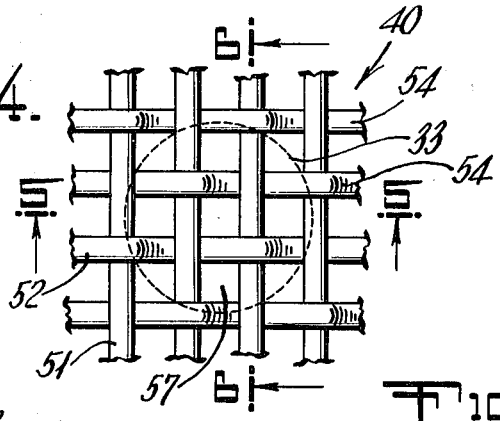
FIG. 4 is a view in perspective of a portion of a backing means that can be used in the apparatus of FIG. 3.
Figure 5:
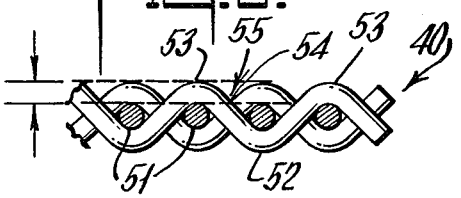
FIG. 5 is a cross-sectional view taken along line 5—5 of FIG. 4.
Figure 6:
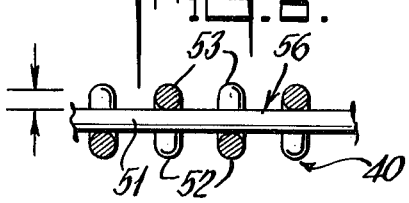
FIG. 6 is a cross-sectional view taken along line 6—6 of FIGS. 4 and 5.

The support member as shown in the embodiments in FIGS. 4, 5, and 6 is foraminous. The support member 40 is formed from coarse woven screen preferably metal, or it may be metal in one direction and textile filaments in the other direction or other coarse woven screens. The wires 51 running vertically in FIG. 4 are straight, while wires 52 running horizontally weave alternately over and under wires 51. Protuberances 53 are present throughout the foraminous screen as the top most part of each "knee" of a given strand 52 of the screen that is formed as the strand weaves over and under the strands 51 that lie perpendicular to it.

As a given strand 52 slants downward to pass under a strand 51 perpendicular to it, it crosses two other strands 52 disposed on either side of it, as those strands slant upward to pass over the same perpendicular strand that the given strand will pass under. Each series of such "crossing points" 54 forms a trough, such as trough 55, formed by crossing points 54 in FIGS. 4 and 5 that lies between adjacent protuberances 53. The effective shape of trough 55, as can be best seen in FIG. 5 (which shows a cross section of element 40 of which a plan view is given in FIG. 4) is substantially an inverted triangle.

A series of slightly deeper troughs 56 is formed between adjacent protuberances 53 but extending at right angles to troughs 55. As best seen in FIG. 6, the bottom of each trough 56 is formed by portions of straight strands 51, with successive protuberances 53 on each side of the trough forming the tops of the troughs. As seen in FIG. 6, the effective shape of trough 56 may be characterized as a shallow "U" shape.

As shown in FIG. 5, plurality of troughs 55 and a plurality of protuberances 53 alternate in one direction across the surface of the backing means. FIG. 6 also shows a plurality of troughs 56 and a plurality of protuberances 53 alternate in a direction perpendicular to troughs 55. Hence, a plurality of troughs and a plurality of protuberances alternate in both the longitudinal and transverse directions of the backing means 50.

The backing member 40 passes about the drum and separates from the drum at guide roll 41 which rotates on shaft 42. The backing member passes downwardly around guide roll 43 rotating on a shaft 44 and then rearwardly over vertically adjustable tension and tracking guide roll 45 rotating on a shaft 46 and then around guide roll 47 on a shaft 48. The member passes upwardly and around guide roll 49 rotating on shaft 50 to be returned about the periphery of the drum.

The drum and supporting belt provide a rearranging zone between them through which a fiber starting material may move to be rearranged under the influence of applied fluid forces to a non-woven fabric having a plurality of patterns throughout its area. Tension on the support member is controlled and adjusted by the tensioning and tracking guide roll. The guide rolls are positioned in slidable backets which are adjustable to assist in the maintenance of the proper tension of the support member. The tension required will depend upon the weight of the fibrous web being treated and the amount of rearrangement and patterning desired in the final product.

Apertured drum 30 rotates in the direction of the arrow shown, and support member 40, moves in the same direction and at the same peripheral speed as the drum, and within the indicated guide channels so that both longitudinal and lateral translatory motion of the backing means, the apertured forming means, and the fibrous layer with respect to each other are avoided. The fibrous material 60 to be rearranged is fed between the drum and support member at point A, passes through the first fiber rearranging zone where fluid rearranging forces are applied to it. The backing member with the fibrous material is then removed from the drum at point B and is placed back onto the drum at point C so that there is now a new relationship between the apertures in the drum, the fibrous material, and the backing member and is now passed through a second rearranging zone for a second rearrangement. The fabric in its new form is removed from between the support member and the aperture drum at point D. As the fibrous material passes through the fiber rearranging zones, a liquid such as water is directed against the inner surface of rotating apertured drum through the nozzles mounted inside the drum. The liquid passes through drum apertures and through the fibrous web and, hence, through the backing means thereby affecting rearrangement of the fibers of the web. In the first rearranging zone, the liquid passes through in one manner and in one relationship of apertures, fibers and backing member, and in the second rearranging zone, the relationship of the apertures, fibers and backing member has been altered to obtain a second type of rearrangement.

Vacuum assist boxes 64 and 65 are located against the outside surface of the backing means. The vacuum boxes have a slotted surface located closely adjacent to the outer surface of the belt and through which suction is caused to act upon the web. Suction thus applied assists in re-arrangement of the fibers as the web material passes through the rearranging zones. In addition, it serves to help de-water the web and prevent flooding during fiber rearrangement.

The directions the streams of rearranging fluid projected through the apertures of the drum 30 take as they move into and through the fibers web determine the types of forces applied to the fibers and, in turn, the extent of rearrangement of the fibers. Since the directions the streams of rearranging fluid take after they pass through the apertures 33 are determined by the foraminous backing member, it follows that it is a combination of the patterns in the drum and backing member that at least in part determine the patterns of holes and other areas of low fiber density in the resulting fabric.

The rearranged web or fabric of the present invention may be treated with an adhesive dye or other impregnating printing or coating material in a conventional manner. For example, to strengthen the rearranged web, any suitable adhesive bonding materials or binders may be included in an aqueous or non-aqueous medium employed as the rearranging fluid. Or an adhesive binder may, if desired, be printed on the rearranged web to provide the necessary fabric strength. Thermoplastic binders may, if desired, be applied to the fibrous web in powder form before, during, or after rearrangement, and then fused to bond the fibers.

The optimum binder content for a given fabric according to this invention depends upon a number of factors, including the nature of the binder material, the size and shape of the binder members and their arrangement in the fabric, the nature and length of the fibers, total fiber weight and the like. In some instances, because of the strength of the fibers used or the tightness of the interentangled areas connected to the discontinuous portions, no binder at all need be employed to provide a usable fabric.

Also, wood pulp fibers may be incorporated along with the textile fibers and rearranged along with the textile fibers.

Although I have described a single drum and belt or backing means unit, wherein I take the belt away from the drum and then place it back on the drum, two drums and belts in series or more may be used to accomplish the same objective. I can also use two drums and one belt with the belt going about a substantial portion of the periphery of one drum, removed therefrom, and then about a substantial portion of the periphery of a second drum. Depending upon the number of times that I remove the belt and web from the aperture means and replace it thereto and, of course, on the amount of pressure used in the nozzles will determine the ultimate strength of the final fabric.

The fluid may be applied to the material at anywhere from about 30 pounds per square inch up to 200 to 250 pounds per square inch or even higher, though higher pressures are not required.

The following are illustrative examples of the method and apparatus of this invention to produce the novel patterned non-woven fabrics of the present invention.

EXAMPLE I

In apparatus as illustrated in FIG. 3, a web of loosely assembled fibers, such as may be obtained by air laying apparatus, is fed between an apertured forming drum and the backing means. The web weight is about 620 grains per square yard and its fiber orientation ratio approximately one to one. The web is made from viscose rayon fibers approximately 1½ inches long of 1.5 denier.

Apertured forming means has about 120 substantially round holes per square inch, each approximately 0.065 inch in diameter. The holes are arranged in a staggered pattern over the forming means. Each aperture is spaced on approximately 0.09 inch centers from immediately adjacent apertures on the drum both about the periphery of the drum and transverse of the drum.

The backing member is a woven polyester screen of approximately 23 by 23 mesh or substantially 529 openings per square inch.

The web is placed on the backing member and water is projected from nozzles through apertures in the apertured drum and thence through the fibrous web and the backing member into the vacuum assist box. The apertured forming means, web and backing means have a linear speed of 30 feet per minute.

Approximately 180 gallons per minute of warm water at 110° F. and pressures of about 190 psi are projected against the drum. The backing member with the rearranged web thereon is removed from the drum and placed back on the drum as shown in the drawing. Water is again projected from nozzles through apertures in the apertured drum and through the fibrous web and out the backing member into the vacuum assist box. Approximately 180 gallons per minute of water at pressures of about 190 psi are used in the second treatment.

The nozzles used in both treatments comprise four rows on one inch centers. Fourteen nozzles per row are used with the nozzles staggered in each row. Each nozzle has a diameter of 75 mils.

With the conditions indicated, good fiber rearrangement and entanglement are obtained, and a non woven fabric such as shown in the photomicrograph in FIG. 1 is produced.

The fabric produced is tested for tensile strength in both the machine direction and the cross direction of the final fabric. The machine direction tensile strength is 5 pounds and the cross directional tensile strength is 4.25 pounds. The fabric may be used as a wiping cloth or as a cover for an absorbent product or similar end uses. The fabric is very soft and absorbent.

EXAMPLE II

Utilizing two rearranging drums arranged in series, a web of loosely assembled fibers, such as may be obtained by air-laying apparatus, is fed between the first apertured forming drum and the first backing means. The average web weight is 537 grains per sq. yard. The web has an average fiber orientation ratio of approximately 1.5 to 1. The web is made from rayon fibers approximately 1½ inches long and 1½ denier. Both apertured formations; that is, both the first and second drum, have about 225 substantially round holes per square inch with each hole approximately 0.045 inch in diameter. The holes are arranged in a square pattern over the forming means. The backing member used on both drums is a woven screen with polyester filaments running in a longitudinal direction of the screen and steel filaments running in the transverse direction of the screen. The mesh of the screen is 22×24. The web is placed on the backing member and water projected from nozzles through the apertures in the apertured drum, and then through the fibrous web and the backing member. The web is then fed onto the second backing member and the process repeated. The apertured forming means, web, and backing have a linear speed of approximately 100 feet per minute. Approximately 2500 gallons per minute of warm water at 150° F. and pressures of about 200 PSI are projected through the web, 1250 gallons being projected in the first drum, and approximately 1250 gallons being projected in the second drum. In both drums, there are seven rows of nozzles with 40 nozzles per row spaced on 1" centers. Each nozzle has a diameter of about 75 mils.

Two hundred thousand yards of fabric is produced and samples tested for tenacity and bulk density. The tenacity ranges from 0.515 to 0.593 lbs. per inch of width per 100 grains per sq. yard, and the bulk density ranges from 0.0517 to 0.0624 grams/cubic centimeter. The average absorbency of the fabric is about 11 times its own weight. The fabric may be used as an absorbent sponge.

EXAMPLE III

A web of loosely assembled fibers such as may be obtained by air-laying apparatus is fed between an apertured forming drum and a backing means. The web weight is about 700 grains/sq. yard and has a fiber orientation of approximately 1½ to 1. The web is made from viscose rayon fiber, approximately 1½ inches long and 1½ denier.

The forming means has about 112 substantially round holes per square inch, each hole approximately 0.1 inch in diameter. The holes are arranged in a staggered pattern.

The backing member used a woven polyester screen of approximately 23×23 mesh or substantial 529 openings per square inch. The web is placed on the backing member and water is projected from nozzles through the apertures in the apertured drum and thence through the fibrous web. The apertured forming means, web, and backing means have a linear speed of about 15 feet per minute.

Approximately 180 gallons per minute of warm water at 110° F. and pressures of about 190 PSI are projected against the drum. The backing member with the rearranged web thereon is removed from the drum and placed back on the drum as shown in FIG. 3 of the drawings. Water is again projected from nozzles through apertures in the apertured drum and through the fibrous web. Approximately 180 gallons of water at a pressure of about 190 PSI are used in the second treatment. The nozzles used in both treatments comprise 4 rows on 1" centers. Fourteen nozzles per row are used and nozzles are staggered in each row with each nozzle having a diameter of 75 mils. The fabric produced is tested for a tenacity and bulk density. The tenacity of the fabric is 0.62 lbs. per inch per 100 grains/sq. yard and the bulk density of the fabric is 0.082 grams per cubic centimeter. The fabric is suitable as an absorbent wiping cloth.

EXAMPLE IV

A web of loosely assembled fibers such as is obtained by air-laying apparatus is fed between a first apertured forming drum and a first backing means. The web weighs about 700 grains per sq. yard and has a fiber orientation of approximately $1\frac{1}{2}$ to 1. The web is made of viscose rayon fibers, approximately $1\frac{1}{2}$ inches long and $1\frac{1}{2}$ denier. The first apertured forming means has about 233 substantially round holes per square inch, each approximately 0.045 inches in diameter. The holes are arranged in a square pattern over the forming means. The first backing member is a woven polyester screen of approximately 23×23 mesh or substantially 529 openings per square inch. The polyester filaments used have a diameter of 0.011 inches. The web is placed on the backing member and water is projected from nozzles through the apertures in the apertured drum and thence through the fibrous web. The apertured forming means, the web, and backing means have a linear speed of about 19 feet per minute. Approximately 180 gallons per minute of water at 110° F. and pressures of about 190 PSI are projected against the drum. The web is then passed around a second apertured forming drum of the same construction as the first drum, but the backing member used on the second drum is a 6×6 polyester screen with the polyester filaments having a diameter of 0.039 inches. In the second rearranging step, approximately 180 gallons per minute of warm water at 110° F. and pressures of about 190 PSI are projected against the drum. The nozzles used in both treatments for projecting the water comprise 8 rows of nozzles on 1" centers. Fourteen nozzles per row are used and the nozzles are staggered in each row. Each nozzle has a diameter of 75 mils. The fabric produced is tested for both tenacity and bulk. The tenacity of the fabric is 0.55 lbs. per inch of width per 100 grains/sq. yard and the bulk density is 0.041 grams per cubic centimeters. The fabric is suitable for use as an absorbent wipe.

The above detailed description has been given for clearness and understanding only. No unnecessary limitations should be understood therefrom, as modifications will be obvious to those skilled in the art.

I claim:

1. A non-woven fabric with a plurality of patterns of groups of fiber segments that alternate and extend throughout the fabric which comprises: groups of fiber segments in discontinuous portions of the fabric, said discontinuous portions forming a first pattern, each of said groups including at least one nub of fiber segments interentangled in helter-skelter arrangement, said nub protruding out of the plane of the fabric, each of said groups also including at least one yarn-like bundle of fiber segments wherein the fiber segments are in close proximity and substantial parallelism to one another, said first discontinuous portions of the fabric being bound and interconnected by a continuous highly entangled, interlaced fibrous area, said continuous portion forming a second pattern and the fibers in said continuous portion being entangled in substantially all directions including the thickness of the fabric, said fabric having a bulk density of from 0.04 grams per cubic centimeter to 0.084 grams per cubic centimeter and a tenacity of at least 0.5 pounds per inch per 100 grains per square yard.

2. The non-woven fabric of claim 1 wherein said fabric has an absorbent capacity for liquid of at least $7\frac{1}{2}$ times its own weight.

3. The non-woven fabric of claim 2 wherein said fabric has a bulk density of from 0.052 grams per cubic centimeter to 0.078 grams per cubic centimeter.

4. The non-woven fabric of claim 2 wherein said nubs are connected to said yarn-like bundles by ribbons of aligned fiber segments.

5. The non-woven fabric of claim 2 wherein the discontinuous portions are cone shaped with the nubs all on the same surface of the fabric.

6. The non-woven fabric of claim 2 wherein the discontinuous portions are square in shape.

7. The non-woven fabric of claim 2 wherein each nub is substantially surrounded by yarn-like fiber bundles.

8. The method of producing a non-woven fabric having a plurality of patterns of groups of fiber segments that alternate and extend throughout said fabric from a layer of starting fibrous material the individual fibrous elements of which are capable of movement under applied fluid forces which comprises:

(a) supporting said starting material on a foraminous member having a predetermined topography, (b) treating said starting material while so supported with a first pattern of longitudinally and transversely spaced and simultaneously flowing fluid streams, (c) removing said fluid streams while maintaining said treated material on said foraminous member, and (d) treating said material a second time with a second pattern of longitudinally and transversely spaced and simultaneously flowing fluid streams, said second pattern being out of register with the first pattern of longitudinally and transversely spaced fluid streams.

9. The method according to claim 8 wherein the fluid streams are liquid streams.

10. The method according to claim 8 wherein the pattern of longitudinally and transversely spaced fluid streams is the same in both treatments.

11. The method according to claim 10 wherein the fluid streams are liquid streams.

* * * * *